US010426691B2

(12) United States Patent
Howson

(10) Patent No.: US 10,426,691 B2
(45) **Date of Patent: *Oct. 1, 2019**

(54) PORTABLE THERAPEUTIC APPARATUS

(71) Applicant: MyoROM Sports Med II, LLC, Northwood, ND (US)

(72) Inventor: Christopher James Howson, Northwood, ND (US)

(73) Assignee: MyoROM Sports Med II, LLC, Northwood, ND (US)

( * ) Notice: Subject to any disclaimer, the term of this patent is extended or adjusted under 35 U.S.C. 154(b) by 241 days.

This patent is subject to a terminal disclaimer.

(21) Appl. No.: 15/343,459

(22) Filed: Nov. 4, 2016

(65) Prior Publication Data

US 2017/0065480 A1 Mar. 9, 2017

Related U.S. Application Data

(63) Continuation-in-part of application No. 14/714,375, filed on May 18, 2015, now Pat. No. 9,839,572.

(51) Int. Cl.

| | |
|---|---|
| ***A61H 1/00*** | (2006.01) |
| ***A61H 7/00*** | (2006.01) |
| ***A61H 23/06*** | (2006.01) |

(52) U.S. Cl.

CPC ..... *A61H 7/001* (2013.01); *A61H 1/00* (2013.01); *A61H 1/008* (2013.01); *A61H 7/003* (2013.01);

(Continued)

(58) Field of Classification Search

CPC ..... A61H 1/00; A61H 1/0292; A61H 1/0296; A61H 1/008; A61H 1/006;

(Continued)

(56) References Cited

U.S. PATENT DOCUMENTS

| | | | |
|---|---|---|---|
| 1,001,175 | A | 8/1911 | Siebert, Jr. |
| 1,722,662 | A | 7/1929 | David |

(Continued)

FOREIGN PATENT DOCUMENTS

| | | |
|---|---|---|
| DE | 148086 | 5/1981 |
| DE | 29912758 U1 | 10/1999 |

(Continued)

OTHER PUBLICATIONS

English translation for DE29912758, espacenet.com, translated on Feb. 19, 2019.*

(Continued)

*Primary Examiner* — Tu A Vo

(74) *Attorney, Agent, or Firm* — Schwegman Lundberg & Woessner, P.A.

(57) ABSTRACT

A portable therapeutic device can include a handle, a rod, a resistance element, and an adjustment element. The handle can define a first slot and a second slot. The first slot can extend into the handle forming an opening in the handle and the second slot can be adjacent to the first slot. The rod can be translatable within the first slot and can extend from the opening. The resistance element can be disposed in the second slot and can be engageable with the rod to apply a resistance force to the rod. The adjustment element can be coupleable to the resistance element, and the adjustment element can be configured to adjust the resistance force.

20 Claims, 9 Drawing Sheets

(52) U.S. Cl.
CPC ..... *A61H 23/06* (2013.01); *A61H 7/007* (2013.01); *A61H 2201/018* (2013.01); *A61H 2201/0153* (2013.01); *A61H 2201/0157* (2013.01); *A61H 2201/0192* (2013.01); *A61H 2201/1253* (2013.01); *A61H 2201/1635* (2013.01); *A61H 2201/1664* (2013.01)

(58) Field of Classification Search
CPC ..... A61H 2023/002; A61H 2023/004; A61H 2023/006; A61H 23/06; A61H 2205/04; A61H 2205/125; A61H 39/00; A61H 39/02; A61H 39/04; A61H 2201/0173; A61H 2201/0176; A61H 2201/123; A61H 2201/1253; A61H 2201/1623; A61H 2201/1609; A61H 2201/1619
See application file for complete search history.

(56) References Cited

U.S. PATENT DOCUMENTS

| | | | | | |
|---|---|---|---|---|---|
| 2,048,220 | A * | 7/1936 | Redding | A61H 1/008 | 606/238 |
| 2,078,159 | A * | 4/1937 | Redding | A61H 23/04 | 606/238 |
| 2,421,354 | A * | 5/1947 | Reiter | A61C 3/08 | 433/151 |
| 3,228,392 | A | 1/1966 | Speyer | | |
| 3,706,309 | A * | 12/1972 | Toftness | A61H 39/04 | 606/238 |
| 4,116,235 | A * | 9/1978 | Fuhr | A61H 1/008 | 606/238 |
| 4,461,286 | A * | 7/1984 | Sweat | A61H 1/008 | 606/238 |
| 4,498,464 | A | 2/1985 | Morgan, Jr. | | |
| 4,669,454 | A * | 6/1987 | Shamos | A61H 1/008 | 173/120 |
| 4,716,890 | A * | 1/1988 | Bichel | A61H 23/04 | 601/108 |
| 5,626,615 | A * | 5/1997 | Keller | A61H 1/008 | 601/107 |
| 5,632,765 | A * | 5/1997 | Holder | A61H 23/06 | 601/108 |
| 5,656,017 | A * | 8/1997 | Keller | A61H 1/008 | 601/107 |
| 5,662,686 | A * | 9/1997 | Newsum | A61H 23/06 | 30/367 |
| 5,954,750 | A * | 9/1999 | Steffensmeier | A61G 13/009 | 606/237 |
| 6,379,375 | B1 * | 4/2002 | Fuhr | A61H 1/008 | 601/107 |
| 7,351,897 | B2 | 4/2008 | Woods | | |
| 7,967,732 | B2 | 6/2011 | D'Addario et al. | | |
| 8,357,108 | B2 | 1/2013 | Taylor | | |
| 9,839,572 | B2 | 12/2017 | Howson | | |
| 2007/0270727 | A1 | 11/2007 | Khorassani Zadeh | | |
| 2008/0312724 | A1 | 12/2008 | Khan et al. | | |
| 2009/0005812 | A1 | 1/2009 | Fuhr | | |
| 2011/0224580 | A1 | 9/2011 | Leathers et al. | | |
| 2013/0267876 | A1 | 10/2013 | Leckenby et al. | | |
| 2014/0188169 | A1 | 7/2014 | Jacobs | | |

FOREIGN PATENT DOCUMENTS

| | | | | |
|---|---|---|---|---|
| DE | 29912758 | U1 * | 11/1999 | A61H 23/06 |
| DE | 112016002279 | | 2/2018 | |
| KR | 101207389 | B1 | 12/2012 | |
| WO | WO-2016187206 | A1 | 11/2016 | |

OTHER PUBLICATIONS

"German Application Serial No. 11 2016 002 279.4, Response filed Sep. 11, 2018 to Office Action dated Apr. 9, 2018", W English Claims, 13 pgs.
"German Application Serial No. 11 2016 002 279.4, Office Action dated Apr. 9, 2018", w/English Translation, 9 pgs.
"Canadian Application Serial No. 2,986,422, Response filed Jul. 16, 2018 to Office Action dated Jan. 17, 2018", 17 pgs.
"German Application Serial No. 11 2016 002 279.4, Office Action dated Apr. 9, 2018", W O English Translation, 5 pgs.
"U.S. Appl. No. 14/714,375, Non Final Office Action dated Apr. 19, 2017", 29 pgs.
"U.S. Appl. No. 14/714,375, Response filed Mar. 22, 2017 to Restriction Requirement dated Jan. 26, 2017", 8 pgs.
"U.S. Appl. No. 14/714,375, Response filed Jul. 18, 2017 to Non Final Office Action dated Apr. 19, 2017", 23 pgs.
"U.S. Appl. No. 14/714,375, Restriction Requirement dated Jan. 26, 2017", 6 pgs.
"International Application Serial No. PCT/US2016/032888, International Preliminary Report on Patentability dated Nov. 30, 2017", 9 pgs.
English translation for DE 29912758, [Online]. Retrieved from the Internet: espacenet.com, (Aug. 16, 2017), 4 pgs.
"U.S. Appl. No. 14/714,375, Notice of Allowance dated Sep. 7, 2017", 11 pgs.
"U.S. Appl. No. 14/714,375, Examiner Interview Summary dated Sep. 7, 2017", 1 pg.
"German Application Serial No. 112016002279.4, Office Action dated Oct. 25, 2018", w o English Translation, 5 pgs.
Extremity Drop / Speeder Board, Thuli Tables—Fine Chiropractic Products, downloaded on Internet on Jun. 22, 2015 at http://thulitables.com/products/extremity-drop-thuli-table-accessory/, 2 pgs.
"U.S. Appl. No. 14/714,375, Preliminary Amendment filed Sep. 23, 2016", 7 pgs.
"CAT®—Chiropractic Adjusting Tool Family", Downloaded on Internet Jun. 22, 2015 at http://jtechmedical.com/CAT-chiropractic-Adjusting-Tool-Family/cat-family, 5 pgs.
"CAT® EX—Extended Thrust Chripractic Adjusting Tool", Downloaded on Internet Jun. 22, 2015 at http://www.jtechmedical.com/CAT-Chiropractice-Adjusting-Tool-Family/cat-ex-extended-thrust-chiropractice-adjusting-tool, 3 pgs.
"CAT® LT—Low Thrust Chiropractic Adjusting Tool", Downloaded on Internet Jun. 22, 2015 at http://www.jtechmedical.com/CAT-Chiropractic-Adjusting-Tool-Family/cat-lt-low-thrust-chiropractic-adjusting-tool, 3 pgs.
"CAT® Pro Select", Downloaded on Internet Jun. 22, 2015 at http://www.jtechmedical.com/CAT-Chiropractic-Adjusting-Tool-Family/cat-pro-select, 3 pgs.
"International Application Serial No. PCT/US2016/032888, International Search Report dated Aug. 16, 2016", 2 pgs.
"International Application Serial No. PCT/US2016/032888, Written Opinion dated Aug. 16, 2016", 7 pgs.
"Straight Drop with Adjustable Tension", Extremity Drop / Speeder Board, taken from Thuli Tables on Jun. 22, 2015, www.thulitables.com, 1 pg.
"The Original CAT®—Chiropractic Adjusting Tool", Downloaded on Internet Jun. 22, 2015 at http://www.jtechmedical.com/CAT-Chiropractice-Adjusting-Tool-Family/cat-chiropractic-adjusting-tool, 3 pgs.
Hammer, Warren, "Extremity Drop Uses", Excerpt from textbook Functional Soft Tissue Examination and Treatment by Manual Methods, at least as early as Feb. 15, 2007, 5 pgs.
"Canadian Application Serial No. 2,986,422, Office Action dated Jan. 17, 2018", 5 pgs.

* cited by examiner

PORTABLE THERAPEUTIC APPARATUS

CLAIM OF PRIORITY

This patent application is a continuation-in-part of U.S. patent application Ser. No. 14/714,375, titled "PORTABLE THERAPEUTIC APPARATUS," to Chris Howson and filed on May 18, 2015, which is pending.

TECHNICAL FIELD

This disclosure generally relates to therapeutic apparatuses including, physical therapy, and/or athletic training apparatuses.

BACKGROUND

Following muscular injury or repetitive strain, scar tissue or disorganized collagen often forms in the body. This aberrant tissue can restrict normal range of motion and slow healing. It is often difficult, painful, and time-consuming to release these areas of adhesion. Currently, chiropractors use large, cumbersome drop mechanisms that are attached to a table to treat areas of adhesion or hands on methods that are time-consuming, painful for the patient, and often a source of repetitive strain for the treating physician.

SUMMARY

In an example, a portable therapeutic device can include a handle, a rod, a resistance element, and an adjustment element. The handle can define a first slot and a second slot. The first slot can extend into the handle forming an opening in the handle and the second slot can be adjacent to the first slot. The rod can be translatable within the first slot and can extend from the opening. The resistance element can be disposed in the second slot and can be engageable with the rod to apply a resistance force to the rod. The adjustment element can be coupleable to the resistance element, and the adjustment element can be configured to adjust the resistance force.

In another example, a method for applying a force to a desired area of a body can include setting a resistance force on a resistance element disposed in a second slot, where the resistance element can apply the resistance to a protrusion extending from an opening in a handle. An initial force can be applied to the handle while the protrusion rests against a desired area of the body. A transitional force less than the initial force can be applied while the protrusion translates in a first slot after the initial force overcomes the resistance force. A final force can be applied when the protrusion impacts a termination of the first slot, wherein the final force is greater than one or both of the transitional force and the initial force.

In yet another example, a portable therapeutic device can include a handle, a rod, a resistance element, a translatable member, and an adjustment element. The handle can define a first slot extending into the handle forming an opening in the handle. The handle can also define a second slot that can be adjacent to the first slot and a third slot aligned with the second slot. The rod can be translatable within the first slot and can extend from the opening. The resistance element can be disposed in the second slot and can be engageable with the rod to apply a resistance force to the rod. The translatable member can be disposed in the second slot and the third slot and can be engageable with the resistance element. The adjustment element can be coupleable to the translatable member, and the adjustment element can be configured to translate the translatable member to adjust the resistance force of the resistance element.

BRIEF DESCRIPTION OF THE FIGURES

The accompanying drawings, which are incorporated in and constitute a part of this disclosure, illustrate various embodiments of the present invention.

DETAILED DESCRIPTION

Figure 1A:
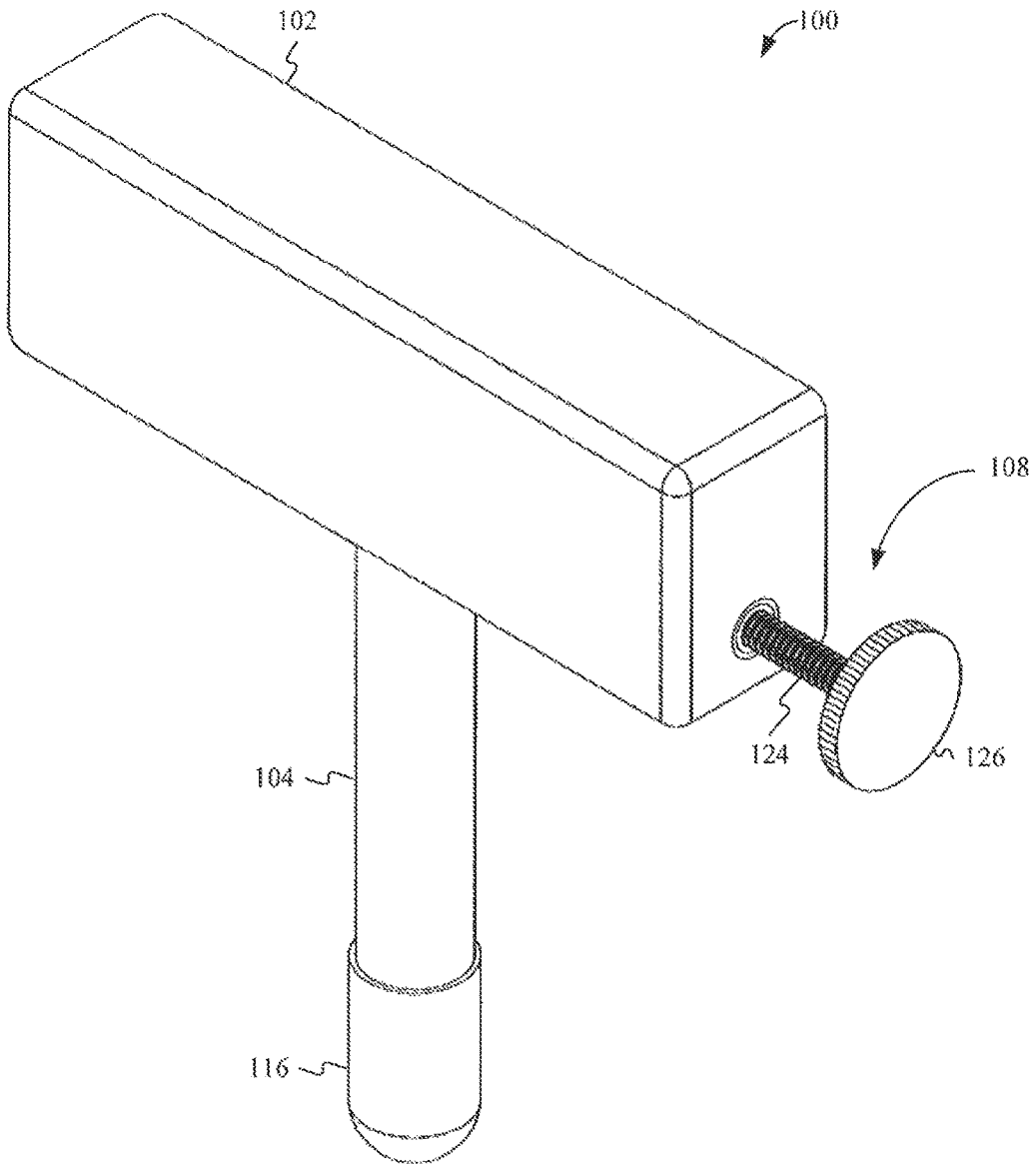
FIG. 1A shows a perspective view of a portable therapeutic device.

The following detailed description refers to the accompanying drawings. Wherever possible, the same reference numbers are used in the drawings and the following description to refer to the same or similar elements. While specific embodiments may be described herein, modifications, adaptations, and other implementations of the specific embodiments are possible and contemplated. For example, substitutions, additions, or modifications may be made to the embodiments, including elements shown in the embodiments, illustrated in the drawings, and the methods described herein may be modified by substituting, reordering, or adding stages to the disclosed methods. Accordingly, the following detailed description does not limit the disclosure.

Portable therapeutic apparatuses disclosed herein can provide a quick way of releasing adhesions by allowing a user to apply a stretch to the tissue that can have a mechanical effect of releasing the adhesion and also can neurologically stimulate reflex relaxation of the tissue. Use of portable therapeutic apparatuses disclosed herein can reduce the time of treatment and can confine discomfort to a very brief moment, rather than a prolonged therapy session.

A problem with currently used drop pieces is that most are stationary and difficult to transport as they are either attached to a table or otherwise cumbersome to transport. In order to trigger a drop, a thrust must be applied in a downward direction, which can be difficult depending on the tissue involved. Currently used drop pieces are large and stationary, requiring the person to lie down. They also limit the body areas one can treat due to the location and direction of the drops. Other manual methods for applying a stretch are painful, hard to tolerate, and are stressful to the user over time.

Portable therapeutic apparatuses consistent with this disclosure may allow the application of a force in the direction of a user's thrust, regardless of a person's body positioning. Portable therapeutic apparatuses consistent with this disclosure also offer portability and versatility that can make portable therapeutic apparatuses consistent with this disclosure both convenient and effective. Portable therapeutic apparatuses consistent with this disclosure are also less taxing to the user, as the portable therapeutic apparatuses consistent with this disclosure can be triggered by using one's body weight rather than the force of thumbs or hands. Treatment using the portable therapeutic apparatuses consistent with this disclosure may also be completed much quicker, thus making the treatment more tolerable.

Consistent with this disclosure, portable therapeutic apparatuses may include a handle having a block shape, a first hole extending centrally within the handle, a second hole extending transverse with respect to the first hole and extending into the first hole. The portable therapeutic apparatuses consistent with this disclosure may also include a rod slidably extending within the first hole, a groove extending around the inner end of the rod, and a softer tip attached to a distal end of the rod. A first ball bearing may be positioned within the second hole to selectively engage the groove in the rod. A spring positioned within the second hole may apply a biasing force to the first ball bearing to engage the groove. A second ball bearing on the opposite side of the spring may rest against a threaded insert extending into the second hole to retain the spring at a minimum level of biasing force. The threaded knob may threadably extend through the threaded insert to engage the second ball bearing thereby allowing for an increase in biasing force by the spring to the first ball bearing. In use, a user applies a downward pressure upon a location of a body with the tip of the rod engaging the location to be treated. As the downward force is applied to the body, the rod eventually pushes upwardly until the groove is no longer engaged by the first ball bearing and the handle continues downwardly to engage the top end of the rod thereby applying a quick impulse to the tissue being treated. The rod is then pulled out of the first hole until the first ball bearing engages the groove and the above process can be repeated. Throughout this disclosure, a user includes, but is not limited to any person utilizing the portable therapeutic apparatus disclosed herein. Non-limiting examples of a user include a chiropractor, a physical therapist, an athletic trainer, an athlete, a person at home or at work, a massage therapist, a veterinarian, etc. Users can use the therapeutic apparatus on themselves or on others such as patients.

Figure 1B:
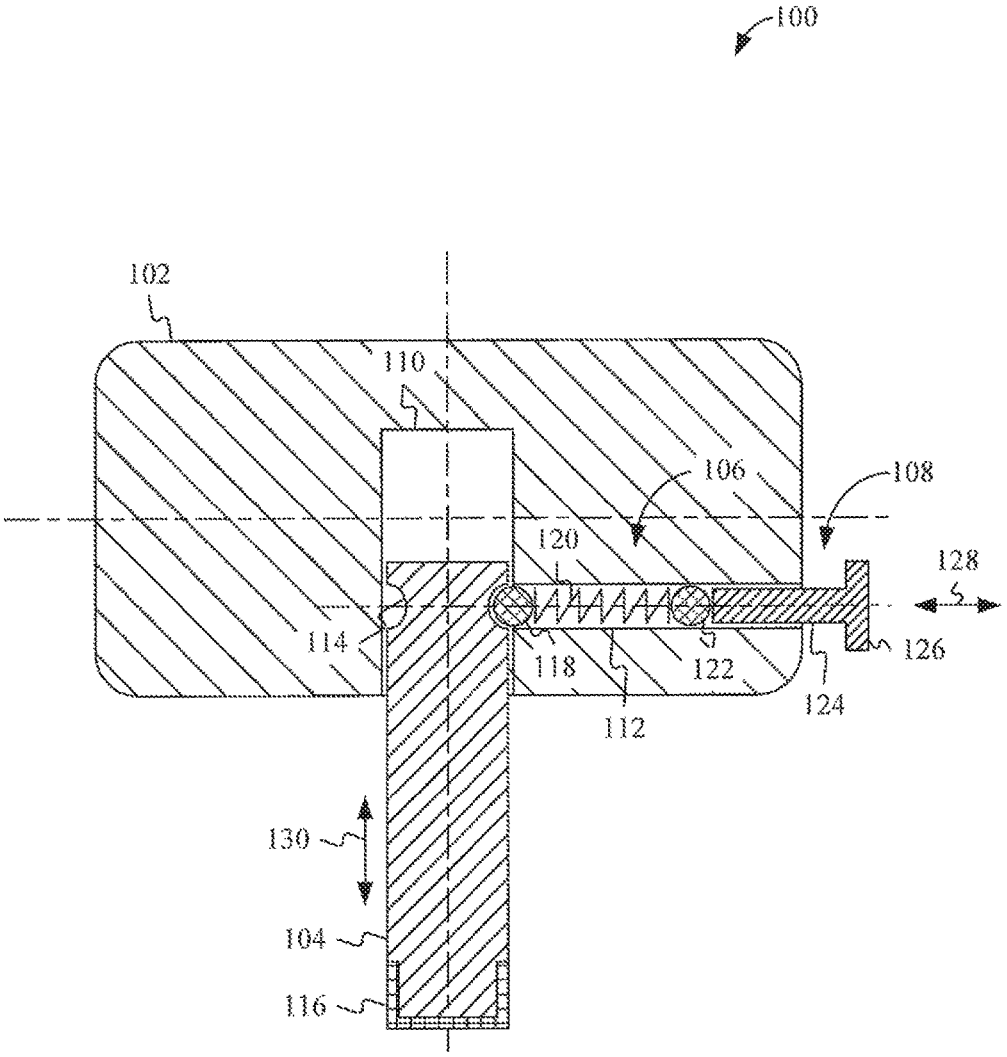
FIG. 1B shows a cross-section of an example of a portable therapeutic apparatus with a protrusion in a first position.
Figure 1C:
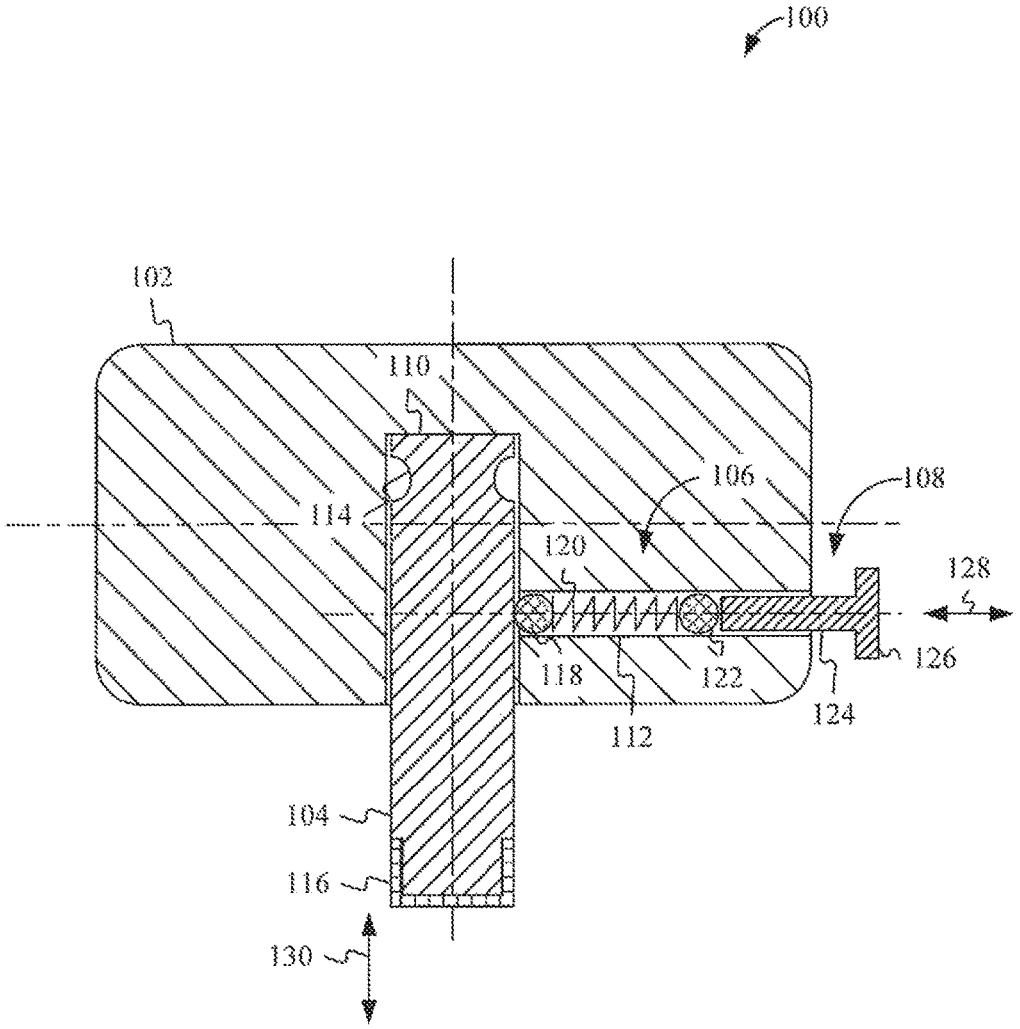
FIG. 1C shows a cross-section of an example of a portable therapeutic apparatus of FIG. 1B with the protrusion in a second position.

FIGS. 1A through 1C show an example of a portable therapeutic apparatus 100, in accordance with this disclosure. In the example of FIGS. 1A through 1C, the portable therapeutic apparatus 100 can include a handle 102, a protrusion 104, a resistance element 106, and an adjustment element 108. The handle 102 can include a first slot 110 and a second slot 112. The protrusion 104 can include an indentation 114 and a cushion or end cap 116. The resistance element 106 can include a first element 118, an elastic element 120, and a second element 122. In some examples, one or both of the first and second elements 118, 122 can be spherical such as ball bearings. In other example configurations, one or both of the first and second elements 118, 122 can be differing shapes. Non-limiting shapes of the first and second elements 118, 122, include, but are not limited to, conical, cylindrical, oblong, etc. In addition, the first element 118 can be a different shape than the second element 122. The adjustment element 108 can include a threaded portion 124 (e.g., a threaded rod) connected to a cap 126. Non-limiting examples of a slot as used herein include, but are not limited to, any opening, cavity, groove, hole or the like in the handle 102.

The handle 102 can be constructed of a number of different materials. Non-limiting examples of materials that can be used to construct the handle 102 include, but are not limited to, woods, ceramics, metals, polymers, or any combination thereof. For example, the handle 102 can be constructed from a block of wood. For instance, the handle 102 can be constructed from a block of oak or other species of wood.

The handle 102 can be constructed via a number of different manufacturing techniques. For example, the handle 102 can be manufactured from a polymer that is injection molded, from a metal that is cast or forged, etc. Other methods for manufacturing the handle 102 include milling the handle 102, regardless of the material used to form an ingot, on a computer numerically controlled (CNC) mill. For example, the ingot for the handle 102 may be manufactured by cutting blocks of wood into rectangular prisms of approximately the correct size of a finished handle. Once the ingot is formed, a CNC mill may bore the first slot 110 in a top surface, the second slot 112 in a side surface, as well as round off the edges to eliminate sharp points that could injure a user. In addition, the handle 102 can be hand crafted using hand tools such as chisels, rasps, etc.

In addition, the handle 102 may be custom fitted to the user. For example, a mold or other template can be created for a user's hands. The mold or template can be used to cast or otherwise form the handle 102 such that the handle 102 better conforms to the user's hands.

The protrusion 104 can be constructed of different materials. Non-limiting examples of materials that can be used to construct the protrusion 104 include, but are not limited to, woods, ceramics, metals, polymers, and combinations thereof. For example, the protrusion 104 may be formed in the shape of a cylinder from a metal (such as aluminum), polymer (such as nylon), ceramic (such as clay), wood (such as oak), etc. The cylinder may or may not contain voids. For instance, as will be described with regards to FIG. 4, a portion of the protrusion 104 may be hollow. In addition, different protrusions may be formed of different materials to allow customization of a treatment program. For example, during a first phase of treatment a first protrusion constructed of a stiff material (i.e., a high Young's modulus) may be utilized and during a second phase of treatment a second protrusion constructed of a less stiff material (i.e., a low Young's modulus) may be utilized.

The protrusion 104 can be constructed in a variety of fashions. For example, the protrusion 104 can be cast, injection molded, milled on a CNC mill, turned on a lathe, etc. For instance, the protrusion 104 can be constructed of a polymer by injection molding. The indentation 114 can be formed at a first end of the protrusion 104 during the injection molding process. Furthermore, the protrusion 104 can be constructed of a polymer rod and the indentation 114 can be cut into the polymer rod on a lathe. The cushion 116 can simply slip over a second end of the protrusion 104. The cushion 116 can be constructed of materials such as, but not limited to, rubber, ceramics, polymers, etc.

The indentation 114 can take many shapes. For instance, the indentation 114 can be a dimple located on the protrusion 104 or the indentation 114 can be a groove covering the full or a partial circumference of the protrusion 104. In addition, while FIGS. 1B and 1C shows a single indentation in the form of a groove around the entire circumference of the protrusion 104, multiple indentations can be formed on the surface of the protrusion 104. The multiple indentations can be the same size and shape or can be different sizes and shapes. For example, a first indentation may be a first groove having a first dimension and a second indentation may be a second groove having a second dimension. Furthermore, a first indentation may be a dimple located on the surface of the protrusion 104 and a second indentation may be a groove.

As shown in FIG. 1B, when the protrusion 104 is in a first position, a portion of the resistance element 106 can rest within a portion of the indentation 114. The portion of the resistance element 106 resting within the indentation 114 can hinder the protrusion 104 from freely moving within the first slot 110. For example, as shown in FIG. 1B, a portion of the first element 118 can rest within a portion of the indentation 114. The amount of force needed to move the protrusion 104 within the first slot 110 is dependent upon factors including, but not limit to, how much of the resistance element 106 rests within the indentation 114, the amount of force the resistance element 106 applies to the protrusion 104, the sizes of the indentation 114 and the resistance element 106, the shapes of the indentation 114 and the resistance element 106, etc.

The resistance element 106 can be constructed from a variety of materials and in a number of fashions. As shown in FIGS. 1B and 1C, the resistance element 106 can include the first element 118, the elastic element 120, and the second element 122. However, the resistance element 106 could include only the elastic element 120. For example, the elastic element 120 could be constructed of an elastic material such that force applied to the elastic element 120, via the adjustment element 108 for example, can be translated into a force that can be applied to a portion of the indentation 114 contacted by the elastic element 120. For instance, the elastic element 120 can be made of a material with a low poison ratio (e.g., cork) and when a force is applied to the elastic element 120 in an axial direction very little radial deformation occurs and the force applied to the elastic element 120 can be translated to the indentation 114. In addition, materials with high poison ratios (e.g. rubber) can also be used as the elastic element 120. For example, the elastic element 120 may include a rubber portion that can be encased within a sleeve (not shown in FIGS. 1A through 1C) that can slide within the second slot 112. When a force is applied to the elastic element 120 in an axial direction the radial expansion of the rubber portion of the elastic element 120 can be constrained by the sleeve and the force can be directed to the protrusion 104.

In addition to materials such as cork and rubber, springs may be used as the elastic element 120. The elastic element 120 can also be selected from a plurality of elastic elements. For instance, the elastic element 120 can be a compression spring that is selected from a plurality of compression springs. In some example configurations, each of the compression springs can have a different spring constant. The differing spring constants can allow the user to select a compression spring that can result in a higher or lower force being required to be applied to the handle 102 in order to cause the protrusion 104 to traverse within the first slot 110.

A single elastic element can be used to customize the force required to cause the protrusion 104 to traverse within the first slot 110. For example, the elastic element 120 can be a compression spring located between the first element 118 and the second element 122. To increase or decrease the force required to cause protrusion 104 to move, the user can rotate the cap 126 clockwise or counterclockwise, respectively, to compress or decompress the elastic element 120.

During use, a user may wish to apply a given pressure to an area of a person's body using the portable therapeutic apparatus 100. During using the user can set a first desired pressure by adjusting the adjustment element 108. More specifically, the user can turn the cap 126 to cause the threaded rod 124 to move into or out of the handle 102 as indicated by arrow 128. The threaded rod 124 may include markings that are calibrated to result in given forces being required to cause the protrusion 104 to move. For instance, to apply the first desired pressure, the user may rotate the cap 126 until a first marking located on the threaded rod 124 is proximate the handle 102. The user may then place the second end of the protrusion 104 on the desired area to be treated. Once the protrusion 104 is in contact with the desired area to be treated, the user can apply a force to the handle 102. As shown in FIG. 1C, when the force applied to the handle 102 exceeds the first desired force, the first indentation 114 can force the first element 118 from the indentation 114 and into the second slot 112. Once the first element 118 clears the indentation 114, the protrusion 104 can move toward the top of the handle 102 within the first slot as indicated by arrow 130. As the handle 102 travels towards the protrusion 104, force against the portion of the body being treated lessens until the protrusion 104 reaches the bottom of the first slot 110. Upon the protrusion 104 reaching the bottom of the first slot 110, the handle 102 can impact, as shown in FIG. 1C, the protrusion 104. The impact can result in an impact force being applied to the desired area of the body. In other words, the handle 102 impacting the protrusion 104 can result in a temporary spike in the force being applied to the desired area of the body. The temporary spike in the force can aid in stretching muscle fibers and otherwise assist in treating the person.

To apply a second desired force, the user can adjust the adjustment element 108 (e.g., by rotating the cap 126) such that a second marking that indicates the second desired force is adjacent the handle 102. Upon repositioning the adjustment element 108, the user can repeat the stages outlined above to apply the second desired pressure to the desired area (or another area) of the body.

Figure 2:
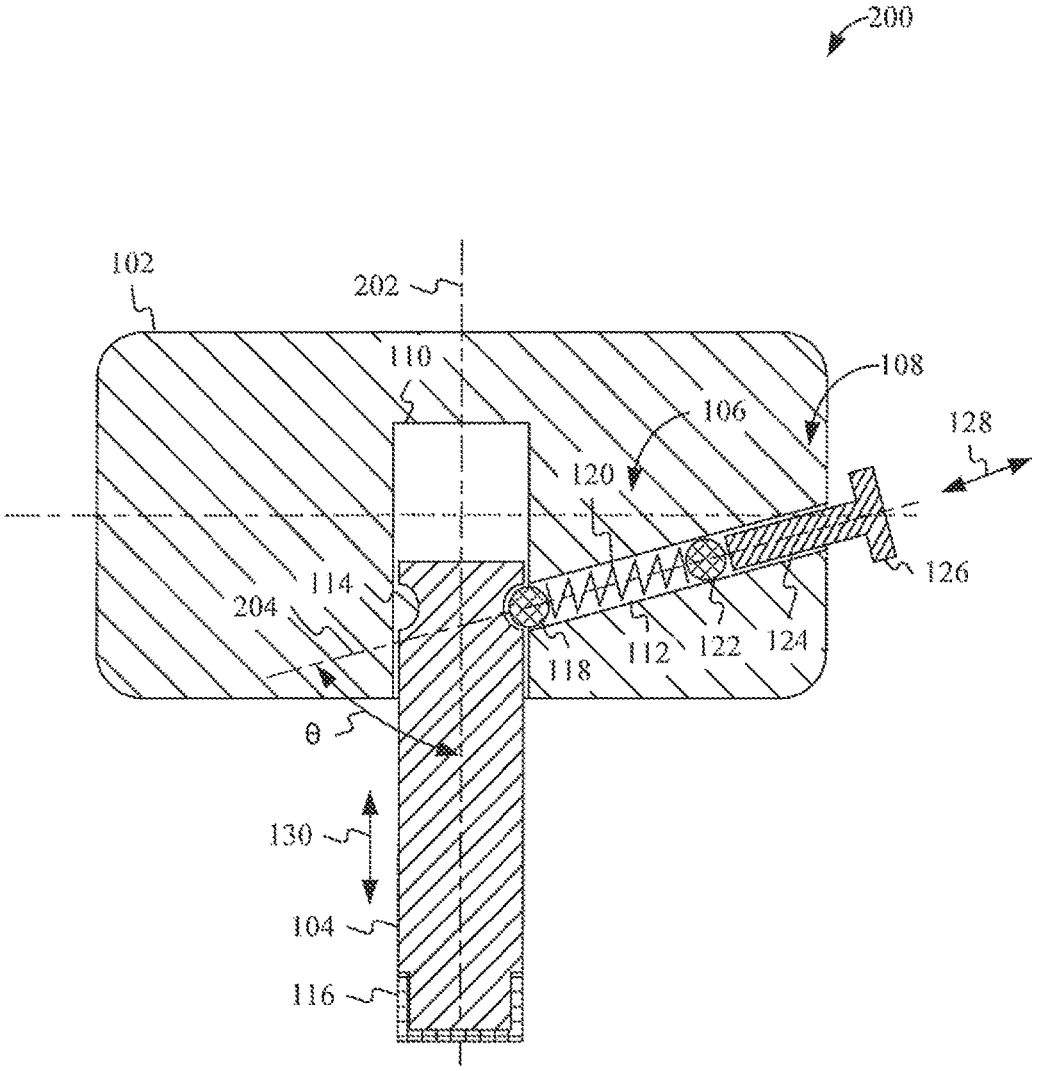
FIG. 2 shows a cross-section of another example of a portable therapeutic apparatus.

FIG. 2 shows another example of a portable therapeutic apparatus 200. The portable therapeutic apparatus 200 shown in FIG. 2 is similar, in both design and construction, to the portable therapeutic apparatus 100 shown in FIGS. 1A through 1C. The difference is that centerlines for the first slot 110 and the second slot 112 in FIGS. 1A through 1C are orthogonal to one another, and in FIG. 2, a first centerline 202 for the first slot 110 and a second centerline 204 for the second slot 112 are non-orthogonal. In other words, in various embodiments consistent with this disclosure the second centerline 204 can intersect the first centerline 202 at an angle θ. Having the second slot 112 intersect the first slot 110 at an angle (e.g., θ) can allow for greater precision in setting the desired force needed to cause the indentation 114 to push the first element 118 into the second slot 112 and thus, allow the protrusion 104 of travel within the first slot 110. The greater precision is a result of the force applied by the user needed to cause movement of the first element 118 being proportional to cos (θ).

Figure 3:
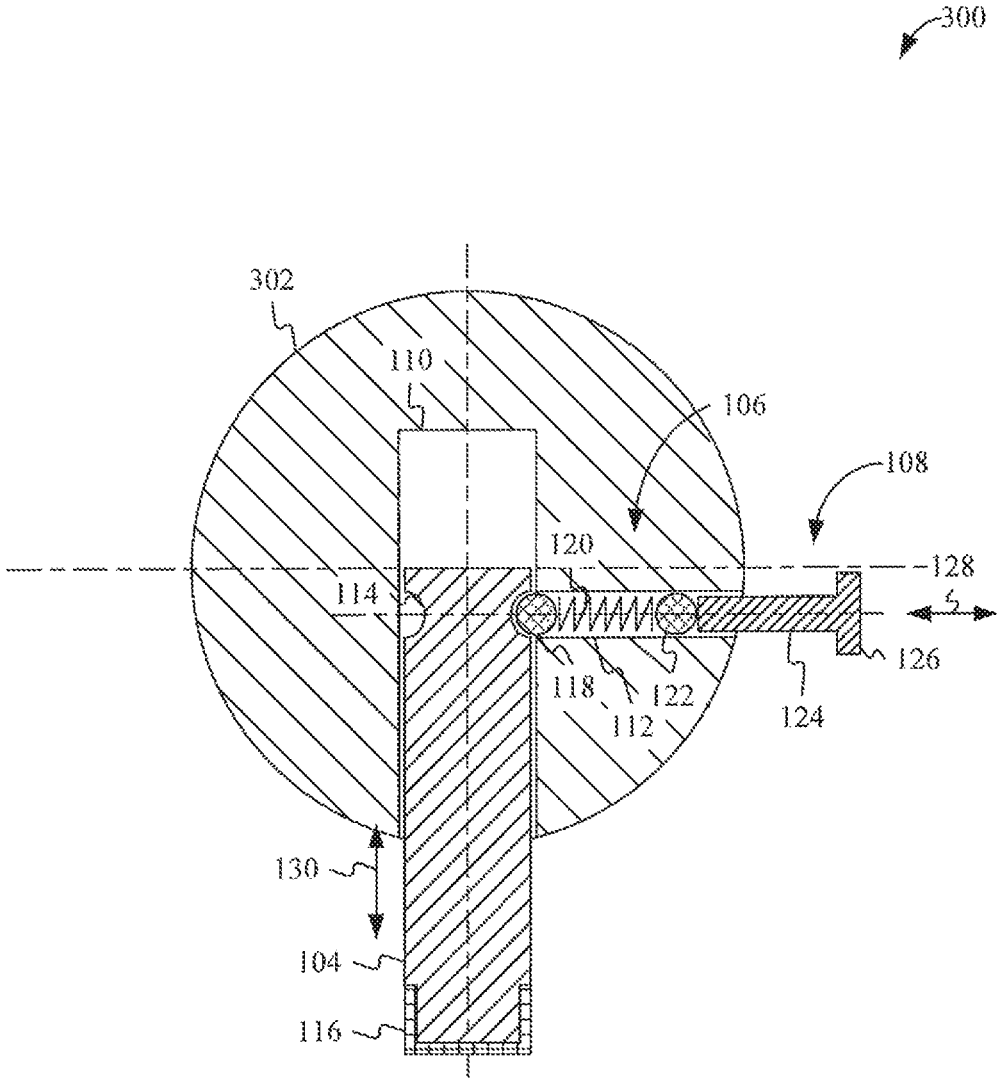
FIG. 3 shows a cross-section of another example of a portable therapeutic apparatus.

FIG. 3 shows another example of a portable therapeutic apparatus 300. The portable therapeutic apparatus 300 shown in FIG. 3 is similar to the portable therapeutic apparatus 100 shown in FIGS. 1A through 1C and the portable therapeutic apparatus 200 shown in FIG. 2. The difference is that a handle 302 shown in FIG. 3 is spherical in shape. The spherical shape of the handle 302 can allow for easier gripping of the handle 302 by the user. The operation and construction of the portable therapeutic apparatus 300 is similar to the operation of the portable therapeutic apparatus 100 shown in FIGS. 1A through 1C and the portable therapeutic apparatus 200 shown in FIG. 2.

Figure 4:
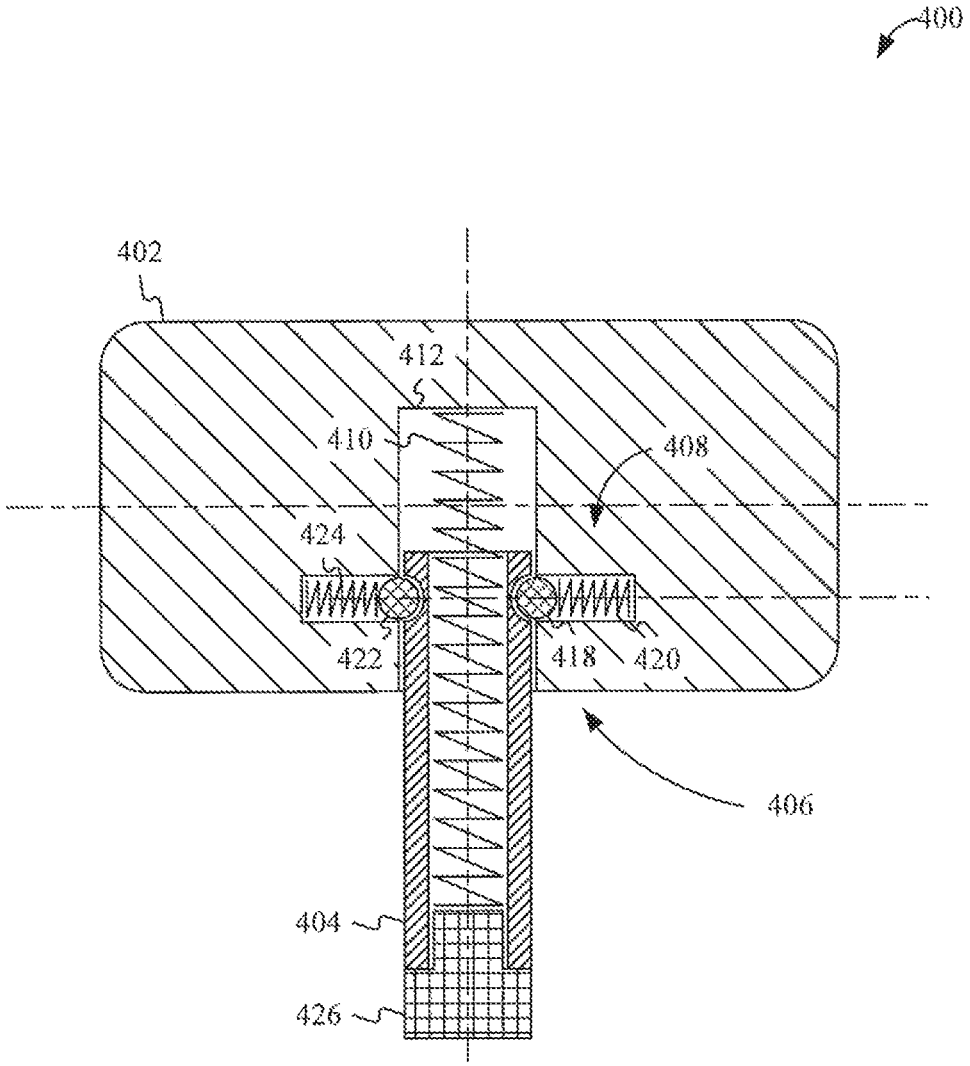
FIG. 4 shows a cross-section of another example of a portable therapeutic apparatus.

FIG. 4 shows a portable therapeutic apparatus 400. The portable therapeutic apparatus 400 includes a handle 402, a protrusion 404, and a resistance element 406. The handle 402 can be constructed and customized as described above with respect to the handle 102. In addition, the handle 402 can be constructed of materials just as the handle 102. In addition, the handle 402 can have shapes similar to those shown in FIGS. 3 and 4 as well as other shapes such as, but not limited to, oblong and cylindrical. The protrusion 404 can be constructed and customized as described above with respect to the protrusion 104. In addition, the protrusion 404 can be constructed of materials just as the protrusion 104.

The resistance element 406 includes a slip element 408 and an extension element 410. As shown in FIG. 4, the slip element 408 includes a first element 418, a first elastic element 420, a second element 422, and a second elastic element 424. The first element 418 and the second element 422 may be spherical, conical, oblong, cylindrical, etc. While FIG. 4 shows the second element 422 and the second elastic element 424, embodiments can be practiced without the second element 422 and the second elastic element 424. The first elastic element 420 and the second elastic element 424 can be constructed in a similar fashion as the elastic element 120 described above.

The extension element 410 can be a tension spring or a compression spring that is selected from a plurality of tension springs or compression springs. During operation, the extension element 410 acts to counter the force applied by the user. For example, a stiff compression spring can cause the user to have to apply a greater force to the handle 402 in order to get the handle 402 to travel within a first slot 412. In other words, the force exerted by the resistance element 406 can remain constant regardless of the extension element 410 used. However, because a stiffer extension element 410 (e.g., a stiffer compression spring) can push back on the handle 402, the user may have to apply a force great enough to overcome the force exerted by the resistance element 410 plus the force of the extension element 410. Thus, once the handle 402 is able to travel within the first slot 412, the user may be applying a greater force to the handle 402 than if the user were using a less stiff extension element 410, or no extension element 410. To change the extension element 410, the user can remove a cap 426 and replace the extension element 410 that can fit within a hollow portion of the protrusion 404. In embodiments without a hollow protrusion, the extension element 410 can fit against an end portion of the protrusion 404. The extension element 410 also serves to provide resistance against the movement of the protrusion 404 when sliding in the first slot 412. This can be beneficial with certain individuals. An extension element can also be used with the embodiments shown in the other figures. For example, with regard to FIGS. 1A through 1C, an extension element can be located between the bottom of the first slot 110 and the end of the protrusion 104 in the first slot 110.

Figures 5A, 5B:
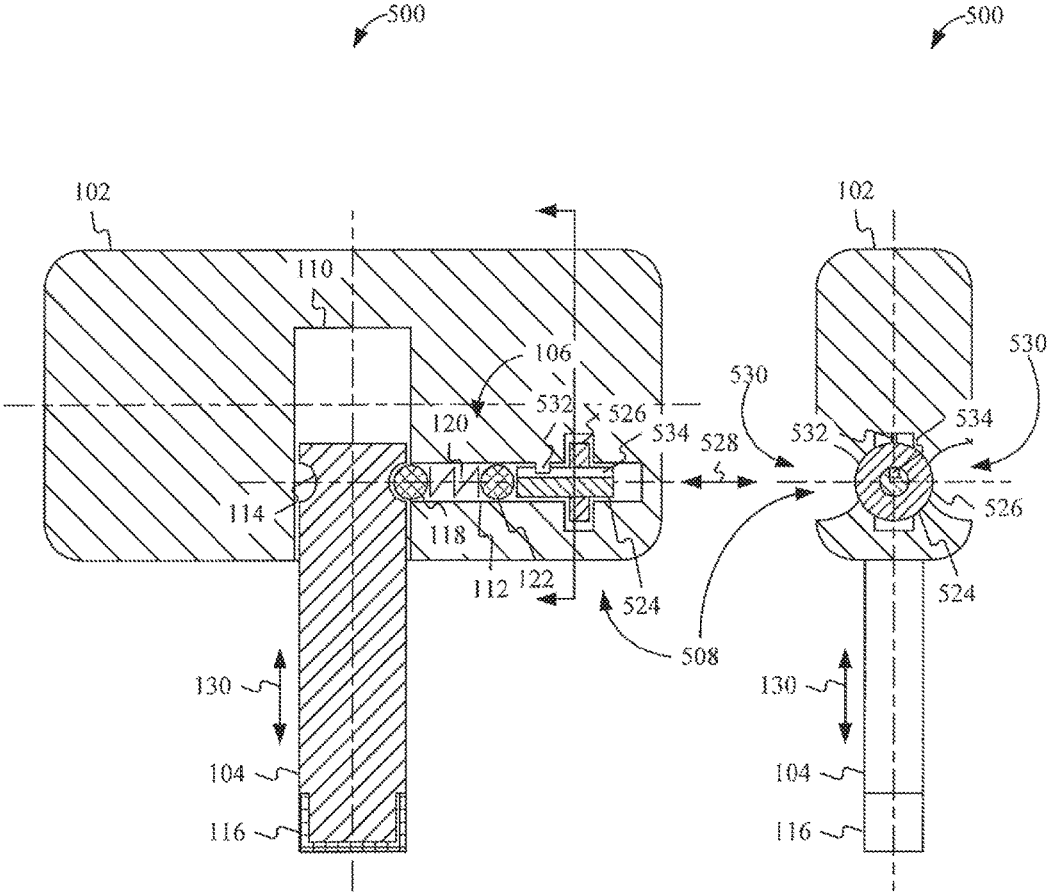
FIGS. 5A and 5B show a cross-section of another example of a portable therapeutic apparatus.

FIGS. 5A and 5B show another example of a portable therapeutic apparatus 500. The portable therapeutic apparatus 500 shown in FIGS. 5A and 5B is similar to the portable therapeutic apparatus 100 shown in FIGS. 1A through 1C, the portable therapeutic apparatus 200 shown in FIG. 2, and the portable therapeutic apparatus 300 shown in FIG. 3. However, FIGS. 5A and 5B show an adjustment element 508 that can be internal to the handle 102. The adjustment element 508 can include a threaded rod 524 that can be internal to the handle 102 and move within the second slot 112. Movement of the threaded rod 524 can be controlled by rotation of a wheel 526. One or more grooves 530 can be milled into the handle 102 such that a portion of the wheel 526 is exposed.

During use, a user can rotate the wheel 526 to cause the threaded rod 524 to move within the second slot 112 as indicated by arrow 528. To keep the threaded rod 524 from rotating when the wheel 526 is rotated, a key 532 can project from a surface of the second slot 112. The key 532 can slide within a keyway 534 formed in the threaded rod 524. The wheel 526 can include markings that are calibrated to result in given forces being required to cause the protrusion 104 to move. For instance, to apply the first desired pressure, the user may rotate the wheel 526 until a first marking located on the wheel 526 is visible in the groove 530. The first marking may correlate the first desired pressure into a force required to cause movement of the protrusion 104.

Figure 6A:
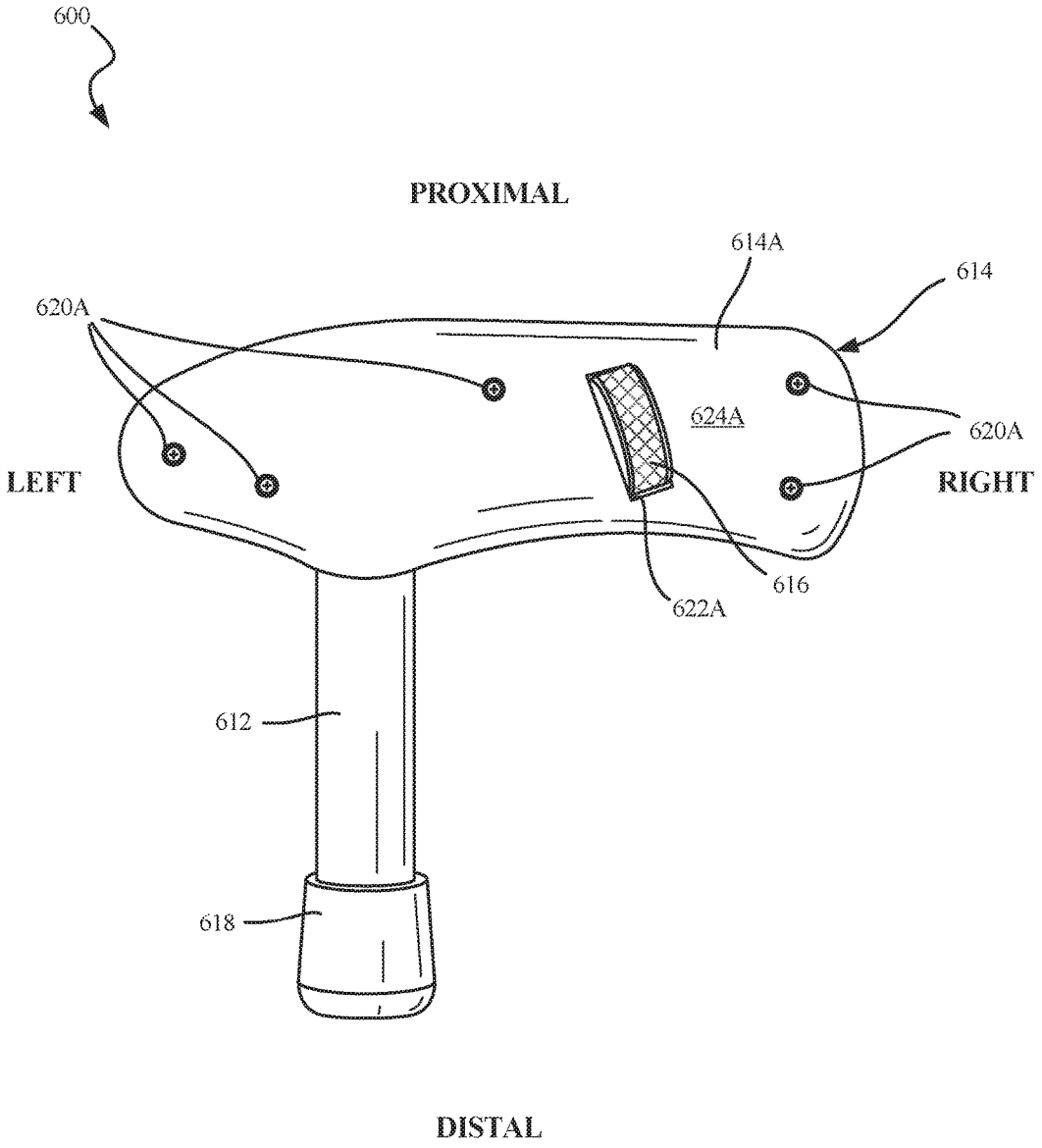
FIGS. 6A and 6B show another example of a portable therapeutic apparatus.
Figure 6B:
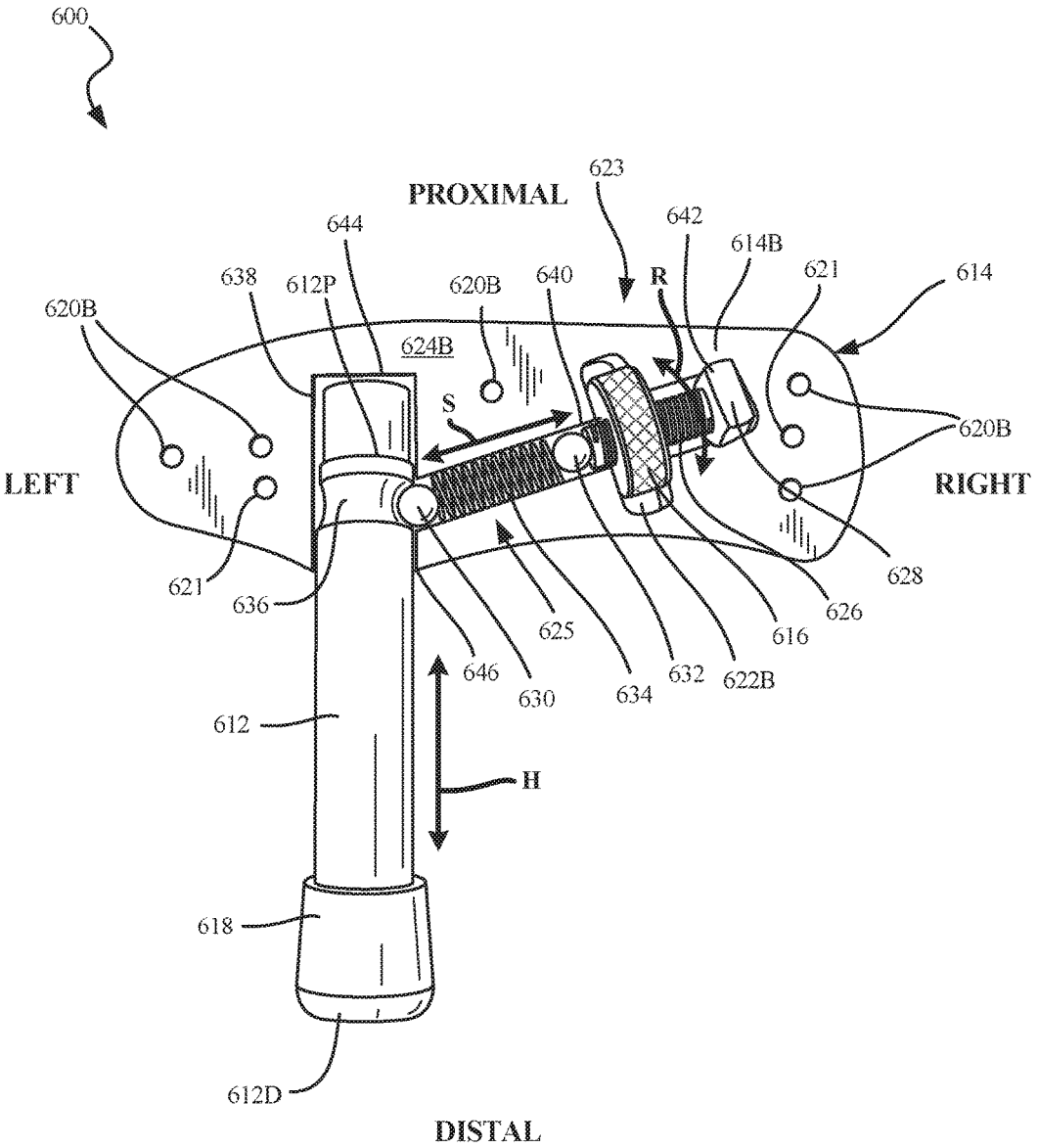

FIG. 6A shows another example of portable therapeutic apparatus 600, and FIG. 6B shows portable therapeutic apparatus 600 with a handle portion removed to show the internal components of portable therapeutic apparatus 600. Portable therapeutic apparatus 600 shown in FIGS. 6A and 6B can be similar to the examples of the portable therapeutic apparatuses of FIG. 1A through FIG. 5B. Portable therapeutic apparatus 600 can differ in that it can include handle 614 that can be simple to disassemble and can include an ergonomic shape. Portable therapeutic apparatus 600 can also differ in that it can include wheel 616 coupled to translatable member 626 having a head 628 configured to prevent rotation of translatable member 626. FIGS. 6A and 6B are discussed concurrently.

As shown in FIG. 6A, portable therapeutic apparatus 600 can include rod 612, handle 614 (including handle side 614A), and wheel 616. Rod 612 can include cap 618. Handle side 614A can include handle bores 620A and 621, wheel cutout 622A, and outer surface 624A.

As shown in FIG. 6B, portable therapeutic apparatus 600 can include rod 612, handle 614 (including handle side 614B), and wheel 616. Rod 612 can include cap 618. Handle side 614B can include handle bores 620B, wheel cutout 622B, and inner surface 624B. Portable therapeutic apparatus 600 can also include adjustment element 623 and resistance element 625. Adjustment element 623 can include wheel 616 and translatable member 626, which can include head 628. Resistance element 625 can include first element 630, second element 632, and elastic element 634. Rod 612 can include proximal end 612P, distal end 612D, and circumferential groove (or indention) 636. Handle 614B can also include first slot 638, second slot 640, and third slot 642. First slot 638 can include termination 644 and opening 646. Also shown in FIG. 6B are directional indication arrows H, S, and R and orientation indicators left, right, proximal, and distal.

The components of the examples illustrated in FIGS. 6A and 6B can be connected and can operate consistently with the examples of FIGS. 1 through 5B. The examples in FIGS. 6A and 6B further include handle bores 620A and 620B which can be bores passing through handle sides 614A and 614B, respectively. Handle bores 620A and 620B can be aligned to receive and secure to fasteners, which can releasably secure handle side 614A to handle side 614B. In operation of one example, a user can quickly remove fasteners to access and replace the internal components within handle 614, such as elastic element 634. Bores 621 can be tooling holes for securing the handle during machining processes.

Also, handle 614 can include second slot 640, which can be aligned with third slot 642, with wheel 616 disposed in wheel cutouts 622A and 622B between second slot 640 and third slot 642. Wheel 616 can be a knurled wheel comprised of metal, plastic, a fibrous material, and the like. Translatable member 626 can be a threaded bolt or other threaded member including head 628, which can being a square head or other shape, such as a hexagon, octagon, and the like. Wheel 616 can be threadably engaged with translatable member 626.

Handle sides 614A and 614B can define first slot 638 that extends into handle sides 614A and 614B, forming opening 646. Handle sides 614A and 614B can also define second slot 640, which can be adjacent to the first slot, but oriented somewhat transversely to first slot 638. Handle sides 614A and 614B can also define third slot 642, which can be aligned with second slot 640, but can be larger than second slot 640 to accommodate head 628.

Rod 612 can be translatable within the first slot in directions indicated by arrow H, and can extend from handle 614 at opening 646. Rod 612 can include distal end 612D, which can protrude from handle 614. Distal end 612D can include cap 618 comprised of a pliable or relatively soft material (such as rubber or silicone), such that distal end 612D can be configured to engage with a body of a patient. Rod 612 can also include proximal end 612P that is insertable into handle 614. Rod 612 can also include circumferential groove 636, which can be adjacent proximal end 612P. Circumferential groove 636 can engage resistance element 625, as described below.

Resistance element 625 can be disposed in second slot 640 and can be engageable with rod 612 to apply a resistance to rod 612. First element 630 can be a spherical element (such as a ball bearing, and the like), which can be disposable in second slot 640, and can be configured to engage circumferential groove 636 to transfer a force to rod 612. Second element 632 can be a spherical element (such as a ball bearing, and the like), disposable in second slot 640 adjacent wheel 616 and can be configured to transfer a force from wheel 616 and translatable member 626 to first element 630. Elastic element 634, which can be a spring, and the like, can be disposed in second slot 640 between first element 630 and second element 632 to transfer forces between rod 612 and translatable member 626 and wheel 616, and allowing rod 612 to move in a desired manner.

Translatable member 626 can disposed in second slot 640 and third slot 642 and can be engageable with resistance element 625. Head 628 can be disposed at a termination of translatable member 626 in third slot 642. Head 628 can have a shape configured to prevent translatable member 626 from rotating relative to handle 614, which can allow translatable member 626 to efficiently translate between second slot 640 and third slot 642. Head 628 can also be engageable with wheel 616 to limit translation of translatable member 626 into second slot 640.

Wheel 616 (adjustment element) can be coupleable to translatable member 626. Wheel 616 can be disposed between second slot 640 and third slot 642, and can be configured to translate translatable member 626 toward second slot 640 when wheel 616 is rotated in a first direction (e.g., left, distally) and toward third slot 642 when wheel 616 is rotated in a second direction (e.g., right, proximally).

In operation of some examples, wheel 616 can be turned in either direction indicated by arrow R to translate translatable member 626 between second slot 640 and third slot 642, where translatable member can translate in the directions indicated by arrow S. For example, wheel 616 can be rotated towards the proximal side along arrow R, which can translate translatable member 626 from third slot 642 toward second slot 640 (right to left) to apply a force (or a larger force) on second element 632, and wheel 616 can be rotated towards the distal side along arrow R, which can translate translatable member 626 from second slot 640 toward third slot 642 to remove a force (or reduce a force) on second element 632. The rotation of wheel 616 and resulting translation of translatable member 626 effectively adjusts the resistance of resistance element 625 and therefore the force applied by second element 630 on circumferential groove 636.

Head 628 can be configured to have a size similar to the size of third slot 642 so that when wheel 616 is turned in either direction R, translatable member 626 cannot rotate, because head 628 will contact third slot 642. This can provide the benefit of allowing wheel 616 to translate translatable member 626 when the threaded engagement between translatable member 626 and wheel 616 has partially adhered or stuck. Also, in some examples, because translatable member 626 cannot spin relative to handle 614, the adjustment made with wheel 616 can be more consistent.

In operation of some examples, resistance element 625, specifically first element 630, can engage rod 612 to prevent rod 612 from translating into first slot 638 when a force applied to rod 612 in a direction toward the handle (proximally) is lower than a resistance force applied by resistance element 625. And, resistance element 625 can allow rod 612 to translate into first slot 638 when the force applied to rod 612 in a direction towards the handle (proximally) exceeds the resistance force. The resistance force can be varied by, for example, turning the wheel 616 to increase or decrease the force of the second element 630 on the groove 636. In this manner, a user can set an initial force or pressure to apply to a patient.

In operation of some examples, handle 614 can define termination 644 first slot 638 sized so that rod 612 engages termination 644 when resistance element 625 allows rod 625 to translate into the slot when the force applied to rod 612 in a direction toward the handle (proximally) exceeds the resistance force. When rod 612 engages termination 644 an impulse or force can be delivered via rod 612. This impulse or force can be higher than the force applied to the patient while the rod 612 translates within slot 638 and can even be higher than the initial force or pressure applied to the patient before the rod overcomes the resistance of the resistance element 625. Thus, like the examples of FIGS. 1 through 5B, the apparatus of FIGS. 6A and 6B can include a rod 612 that i) applies up to an initial force to a patient before overcoming the resistance of the resistance element 625, ii) applies a transitional force less than the initial force while the rod 612 slides in slot 638, and iii) applies a final force greater than the transitional force or even greater than the initial force when the rod 612 impacts the termination 644.

Further Notes and Examples

Example 1 is a portable therapeutic device comprising: a handle defining: a first slot extending into the handle forming an opening in the handle; and a second slot adjacent the first slot; a rod translatable within the first slot and extending from the opening; a resistance element disposed in the second slot and engageable with the rod to apply a resistance force to the rod; and an adjustment element coupleable to the resistance element, the adjustment element configured to adjust the resistance force.

In Example 2, the subject matter of Example 1 optionally includes wherein the rod further comprises: a proximal end insertable into the handle; and a circumferential groove adjacent to the proximal end, the circumferential groove engageable with the resistance element.

In Example 3, the subject matter of Example 2 optionally includes wherein the resistance element further comprises: a first spherical element disposable in the second slot and configured to engage the circumferential groove and transfer a force to the rod.

In Example 4, the subject matter of Example 3 optionally includes wherein the resistance element further comprises: a second spherical element disposable in the second slot engageable with the adjustment element and configured to transfer a force from the adjustment element to the first spherical element.

In Example 5, the subject matter of Example 4 optionally includes wherein the resistance element further comprises: a spring disposable in the second slot between the first spherical element and the second spherical element.

In Example 6, the subject matter of any one or more of Examples 1-5 optionally include wherein the resistance element engages the rod to prevent the rod from translating into the slot when an initial force applied to the rod in a direction toward the handle is lower than the resistance force and to allow the rod to translate into the first slot when the initial force applied to the rod in a direction towards the handle exceeds the resistance force.

In Example 7, the subject matter of any one or more of Examples 1-6 optionally include wherein the first slot includes a termination and the rod is spaced from the termination when the initial force is less than the resistance force and is capable of engaging the termination when the resistance force exceeds the selectable force.

In Example 8, the subject matter of Example 7 optionally includes wherein a centerline of the first slot is non-orthogonal and non-parallel to a centerline of the second slot.

Example 9 is a method for applying a force to a desired area of a body, the method comprising: setting a resistance force on a resistance element disposed in a second slot, the resistance element applying the resistance force to a protrusion extending from an opening in a handle; applying up to an initial force to the handle while the protrusion rests against a desired area of the body; applying a transitional force less than the initial force while the protrusion translates in a first slot after the initial force overcomes the resistance force; and applying a final force when the protrusion impacts a termination of the first slot, wherein the final force is greater than one or both of the transitional force and the initial force.

In Example 10, the subject matter of Example 9 optionally includes adjusting the resistance force by rotating a wheel to translate a translatable element to apply a force on the resistance element.

Example 11 is a portable therapeutic device comprising: a handle defining: a first slot extending into the handle forming an opening in the handle; a second slot adjacent to the first slot; and a third slot aligned with the second slot; a rod translatable within the first slot and extending from the opening; a resistance element disposed in the second slot and engageable with the rod to apply a resistance force to the rod; a translatable member disposed in the second slot and the third slot and engageable with the resistance element; and an adjustment element coupleable to the translatable member, the adjustment element configured to translate the translatable member to adjust the resistance force of the resistance element.

In Example 12, the subject matter of Example 11 optionally includes wherein the rod further comprises: a distal end protruding from handle, the distal end including a cap, the distal end engageable with a body of a patient.

In Example 13, the subject matter of any one or more of Examples 11-12 optionally include wherein the rod further comprises: a proximal end insertable into the handle; and a circumferential groove adjacent the proximal end, the circumferential groove engageable with the resistance element.

In Example 14, the subject matter of Example 13 optionally includes wherein the resistance element further comprises: a first spherical element disposable in the second slot and configured to engage the circumferential groove and transfer a force to the rod.

In Example 15, the subject matter of Example 14 optionally includes wherein the resistance element further comprises: a second spherical element disposable in the second slot adjacent the adjustment element and configured to transfer a force from the adjustment element and the translatable member to the first spherical element.

In Example 16, the subject matter of Example 15 optionally includes wherein the resistance element further comprises: a spring disposable in the second slot between the first spherical element and the second spherical element.

In Example 17, the subject matter of any one or more of Examples 11-16 optionally include wherein the adjustment element further comprises: a wheel disposed between the second slot and the third slot, and configured to translate the translatable member toward the second slot when the wheel is rotated in a first direction and toward the third slot when the wheel is rotated in a second direction.

In Example 18, the subject matter of any one or more of Examples 11-17 optionally include wherein the translatable member further comprises a threaded bolt comprising: a bolt head disposed at a termination of the translatable member in the third slot, the bolt head having a shape configured to prevent the translatable member from rotating relative to the handle allowing the translatable member to translate between the second slot and the third slot, the bolt head engageable with the wheel to limit translation of the translatable member into the second slot.

In Example 19, the subject matter of any one or more of Examples 11-18 optionally include wherein the resistance element engages the rod to prevent the rod from translating into the slot when a force applied to the rod in a direction toward the handle is lower than the resistance force and to allow the rod to translate into the first slot when the force applied to the rod in a direction towards the handle exceeds the resistance force.

In Example 20, the subject matter of Example 19 optionally includes wherein the handle defining the first slot further defines a termination of the first slot so that the rod is capable of engaging the termination when the force applied to the rod in a direction toward the handle exceeds the selectable force.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

The invention claimed is:

1. A portable therapeutic device comprising:

a handle defining:

a first slot extending into the handle forming an opening in the handle; and a second slot adjacent to the first slot;

a rod translatable within the first slot and extending from the opening;

a resistance element disposed in the second slot and engageable with the rod to apply a resistance force to the rod; and an adjustment element coupleable to the resistance element, the adjustment element configured to adjust the resistance force.

2. The portable therapeutic apparatus of claim 1, wherein the rod further comprises:

a proximal end insertable into the handle; and a circumferential groove adjacent to the proximal end, the circumferential groove engageable with the resistance element.

3. The portable therapeutic apparatus of claim 2, wherein the resistance element further comprises:

a first spherical element disposable in the second slot and configured to engage the circumferential groove and transfer a force to the rod.

4. The portable therapeutic apparatus of claim 3, wherein the resistance element further comprises:

a second spherical element disposable in the second slot engageable with the adjustment element and configured to transfer a force from the adjustment element to the first spherical element.

5. The portable therapeutic apparatus of claim 4, wherein the resistance element further comprises:

a spring disposable in the second slot between the first spherical element and the second spherical element.

6. The portable therapeutic apparatus of claim 1, wherein the resistance element engages the rod to prevent the rod from translating into the first slot when an initial force applied to the rod in a direction toward the handle is lower than the resistance force and to allow the rod to translate into the first slot when the initial force applied to the rod in a direction towards the handle exceeds the resistance force.

7. The portable therapeutic apparatus of claim 1, wherein the first slot includes a termination and the rod is spaced from the termination when the initial force is less than the resistance force and is capable of engaging the termination when the resistance force exceeds a selectable force.

8. The portable therapeutic apparatus of claim 7, wherein a centerline of the first slot is non-orthogonal and non-parallel to a centerline of the second slot.

9. A method for applying a force to a desired area of a body, the method comprising:

setting a resistance force on a resistance element disposed in a second slot, the resistance element applying the resistance force to a protrusion extending from an opening in a handle;

applying up to an initial force to the handle while the protrusion rests against a desired area of the body;

applying a transitional force less than the initial force while the protrusion translates in a first slot after the initial force overcomes the resistance force; and applying a final force when the protrusion impacts a termination of the first slot, wherein the final force is greater than one or both of the transitional force and the initial force.

10. The method of claim 9, further comprising:

adjusting the resistance force by rotating a wheel to translate a translatable element to apply a force on the resistance element.

11. A portable therapeutic device comprising:

a handle defining:

a first slot extending into the handle forming an opening in the handle;

a second slot adjacent to the first slot; and a third slot aligned with the second slot;

a rod translatable within the first slot and extending from the opening;

a resistance element disposed in the second slot and engageable with the rod to apply a resistance force to the rod;

a translatable member disposed in the second slot and the third slot and engageable with the resistance element; and an adjustment element coupleable to the translatable member, the adjustment element configured to translate the translatable member to adjust the resistance force of the resistance element.

12. The portable therapeutic apparatus of claim 11, wherein the rod further comprises:

a distal end protruding from the handle, the distal end including a cap, the distal end engageable with a body of a patient.

13. The portable therapeutic apparatus of claim 11, wherein the rod further comprises:

a proximal end insertable into the handle; and a circumferential groove adjacent to the proximal end, the circumferential groove engageable with the resistance element.

14. The portable therapeutic apparatus of claim 13, wherein the resistance element further comprises:

a first spherical element disposable in the second slot and configured to engage the circumferential groove and transfer a force to the rod.

15. The portable therapeutic apparatus of claim 14, wherein the resistance element further comprises:

a second spherical element disposable in the second slot adjacent to the adjustment element and configured to transfer a force from the adjustment element and the translatable member to the first spherical element.

16. The portable therapeutic apparatus of claim 15, wherein the resistance element further comprises:

a spring disposable in the second slot between the first spherical element and the second spherical element.

17. The portable therapeutic apparatus of claim 11, wherein the adjustment element further comprises:

a wheel disposed between the second slot and the third slot, and configured to translate the translatable member toward the second slot when the wheel is rotated in a first direction and toward the third slot when the wheel is rotated in a second direction.

18. The portable therapeutic apparatus of claim 11, wherein the translatable member further comprises a threaded bolt comprising:

a bolt head disposed at a termination of the translatable member in the third slot, the bolt head having a shape configured to prevent the translatable member from rotating relative to the handle allowing the translatable member to translate between the second slot and the third slot, the bolt head engageable with the wheel to limit translation of the translatable member into the second slot.

19. The portable therapeutic apparatus of claim 11, wherein the resistance element engages the rod to prevent the rod from translating into the first slot when a force applied to the rod in a direction toward the handle is lower than the resistance force and to allow the rod to translate into the first slot when the force applied to the rod in a direction towards the handle exceeds the resistance force.

20. The portable therapeutic apparatus of claim 19, wherein the handle defining the first slot further defines a termination of the first slot so that the rod is capable of engaging the termination when the force applied to the rod in a direction toward the handle exceeds a selectable force.

* * * * *